US011149416B2

(12) United States Patent
Parzynski et al.

(10) Patent No.: US 11,149,416 B2
(45) **Date of Patent: *Oct. 19, 2021**

(54) SYSTEM FOR SECURING BITS AGAINST ROTATION

(71) Applicant: Caterpillar Inc., Peoria, IL (US)

(72) Inventors: David B. Parzynski, Peoria, IL (US); Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/748,961

(22) Filed: Jan. 22, 2020

(65) Prior Publication Data

US 2020/0157781 A1 May 21, 2020

Related U.S. Application Data

(62) Division of application No. 15/864,171, filed on Jan. 8, 2018, now Pat. No. 10,590,632.

(60) Provisional application No. 62/444,179, filed on Jan. 9, 2017.

(51) Int. Cl.

| | |
|---|---|
| ***E02F 9/28*** | (2006.01) |
| ***E02F 3/815*** | (2006.01) |
| *B28D 1/18* | (2006.01) |

(52) U.S. Cl.

CPC ..... *E02F 9/2825* (2013.01); *E02F 3/8152* (2013.01); *E02F 9/2816* (2013.01); *E02F 9/2833* (2013.01); *B28D 1/188* (2013.01)

(58) Field of Classification Search

CPC ..... E02F 3/8152; E02F 9/2816; E02F 9/2825; E02F 9/2833; B28D 1/188

See application file for complete search history.

(56) References Cited

U.S. PATENT DOCUMENTS

| | | | | |
|---|---|---|---|---|
| 1,527,388 | A | 2/1925 | Benbow | |
| 3,746,396 | A | 7/1973 | Radd | |
| 4,189,013 | A * | 2/1980 | Adams | E21B 10/38 175/320 |
| 4,316,636 | A | 2/1982 | Taylor | |
| 4,470,210 | A | 9/1984 | Hahn | |
| 4,489,987 | A | 12/1984 | Towers et al. | |
| 4,753,299 | A | 6/1988 | Meyers | |
| 4,779,493 | A | 10/1988 | White | |
| 4,880,122 | A | 11/1989 | Martindell | |
| 4,913,125 | A | 4/1990 | Bunting et al. | |
| 6,712,431 | B1 | 3/2004 | Bosch et al. | |

(Continued)

FOREIGN PATENT DOCUMENTS

| | | |
|---|---|---|
| CN | 102200012 | 9/2011 |
| CN | 202745101 | 2/2013 |

(Continued)

*Primary Examiner* — Gary S Hartmann

(74) *Attorney, Agent, or Firm* — Finnegan, Henderson, Farabow, Garrett & Dunner, LLP

(57) ABSTRACT

A system for use in securing bits against rotation in a motor grader may include a bit, with the bit having a shank. The shank may include a locking portion. The system may include an adapter board including a hole configured to receive the shank of the bit. The system may also include an anti-rotation plate configured to engage the locking portion of the shank of the bit such that the anti-rotation plate constrains the bit against rotation with respect to the adapter board.

7 Claims, 2 Drawing Sheets

(56) References Cited

U.S. PATENT DOCUMENTS

| | | | | |
|---|---|---|---|---|
| 6,953,114 | B2 * | 10/2005 | Wang | B25H 3/003 206/372 |
| 7,419,224 | B2 | 9/2008 | Hall et al. | |
| D606,833 | S | 12/2009 | Robinson | |
| 8,534,766 | B2 | 9/2013 | Ritchey et al. | |
| 8,727,451 | B2 | 5/2014 | Fader et al. | |
| 9,238,893 | B2 | 1/2016 | Latham | |
| 10,590,632 | B2 * | 3/2020 | Parzynski | E02F 3/8152 |
| 2008/0000653 | A1 | 1/2008 | Schwartz | |
| 2009/0261646 | A1 | 10/2009 | Ritchey | |
| 2012/0061112 | A1 | 3/2012 | Sanelli | |
| 2013/0219757 | A1 * | 8/2013 | Justice, Jr. | E02F 3/962 37/455 |
| 2014/0345172 | A1 | 11/2014 | Sheehan et al. | |
| 2014/0373398 | A1 | 12/2014 | Winter | |
| 2016/0024917 | A1 | 1/2016 | Hall et al. | |
| 2019/0316325 | A1 * | 10/2019 | Parzynski, Jr. | E02F 3/815 |
| 2021/0087780 | A1 * | 3/2021 | Parzynski, Jr. | E02F 9/2825 |
| 2021/0087796 | A1 * | 3/2021 | Parzynski, Jr. | E02F 9/2825 |

FOREIGN PATENT DOCUMENTS

| | | |
|---|---|---|
| CN | 204530411 | 8/2015 |
| CN | 204898448 | 12/2015 |
| EP | 0201073 | 11/1986 |

* cited by examiner

SYSTEM FOR SECURING BITS AGAINST ROTATION

CROSS-REFERENCE TO RELATED APPLICATIONS

This application is a division of U.S. patent application Ser. No. 15/864,171, filed Jan. 8, 2018, which claims the benefit of priority of U.S. Provisional Patent Application No. 62/444,179, filed Jan. 9, 2017. The contents of the above-referenced applications are expressly incorporated herein by reference in their entireties.

TECHNICAL FIELD

The present disclosure relates generally to a system for securing bits, and more particularly, to a system for securing bits against rotation in an adapter board of a motor grader.

BACKGROUND

A motor grader shapes or levels the ground by forcing a tool, such as a blade, to bear against the ground over which it is driven. For some applications, the grader is configured with a series of bits instead of a blade to better cut and break up the ground. For this configuration, the blade is replaced with an adapter board securing a plurality of bits.

Some bits are optimized for use in a forward-facing orientation. For example, they may have multiple tooling surfaces optimized to cut and shape the ground when the bit is maintained in a forward-facing orientation. The tooling surfaces may be made from a hard material, such as carbide, greatly reducing the tooling surface's wear rate and thereby increasing the bit's effective life. If such a bit is allowed to freely rotate, however, the other, non-tooling surfaces of the bit contact the ground, wearing the bit out far faster than when it is maintained in a forward-facing orientation.

Adapter boards of motor graders are generally designed to constrain the bits against rotation. For example, the underside of the adapter board may have a series of machined slots interlocking with the bits. Alternatively, a plurality of holes or slots in the adapter board may have non-circular cross-sectional shapes. For example, the slots may have rectangular or square cross sections. The bits may have corresponding non-circular shanks, such that once the shanks are received within a respective hole or slot in the adapter board, they are secured in a forward-facing orientation. Snap rings may be configured to attach to the bits to prevent them from falling out of the hole or slot in the adapter board.

The machined slots on the underside of the adapter board described above may help prevent rotation of the bits, but they may become worn as the underside of the adapter board scrapes and grinds against the ground. Once the machined slots have been completely worn away, they may fail to prevent rotation of the bits. Additionally, snap ring require specialized tools to remove, increasing the difficulty associated with removing and replacing the bits.

One exemplary system for securing bits in a forward-facing orientation is described in U.S. Pat. No. 4,913,125 ("the '125 patent") which issued to Buntin et al. on Apr. 3, 1990. The shank of the bit, which is received within the holding device, has a rectangular cross section. The holding device has a complementary shaped slot for receiving the shank. To prevent the bit from falling out, a spigot and socket is provided.

Although the system of the '125 patent may help secure bits against rotation, machining non-circular slots is generally more costly and time consuming than drilling circular holes. Additionally, the spigot-and-socket configuration involves small, intricate parts, increasing both manufacturing cost and installation difficulty.

The disclosed system is directed to overcoming one or more of the problems set forth above and/or other problems of the prior art.

SUMMARY

In one aspect, the present disclosure is directed to a bit securing system. The bit securing system includes at least two bits, and each bit includes a respective shank. Each shank includes a respective locking portion. The bit securing system includes an adapter board having at least two holes, and each respective hole of the adapter board is configured to receive a shank of a respective bit. An anti-rotation plate is configured to engage the respective locking portions of the shanks of at least two bits such that the anti-rotation plate constrains them against rotation with respect to the adapter board.

In another aspect, the present disclosure is directed to another bit securing system. The bit securing system includes an adapter board having a hole therein. The bit securing system includes a bit having a shank, and the shank has a circular portion and a locking portion. The circular portion is configured to be received within the hole of the adapter board, and the locking portion has a non-circular cross-sectional shape. The bit securing system includes a first anti-rotation plate. The first anti-rotation plate is configured to engage the non-circular cross-sectional shape of the locking portion such that the first anti-rotation plate constrains the shank against rotation with respect to the adapter board.

In another aspect, the present disclosure is directed to another bit securing system. The bit securing system includes a bit having a shank. The shank has an end with a non-circular cross-sectional shape. The bit securing system includes an adapter board having a hole configured to receive the shank of the bit therein. The bit securing system includes an anti-rotation plate configured to contact one or more of an adjacent anti-rotation plate, a second bit, and an interference surface of the adapter board such that the anti-rotation plate is constrained against rotation with respect to the adapter board. The anti-rotation plate is configured to engage the non-circular cross-sectional shape of the shank such that the anti-rotation plate constrains the shank against rotation with respect to the anti-rotation plate.

DETAILED DESCRIPTION

Figure 1:
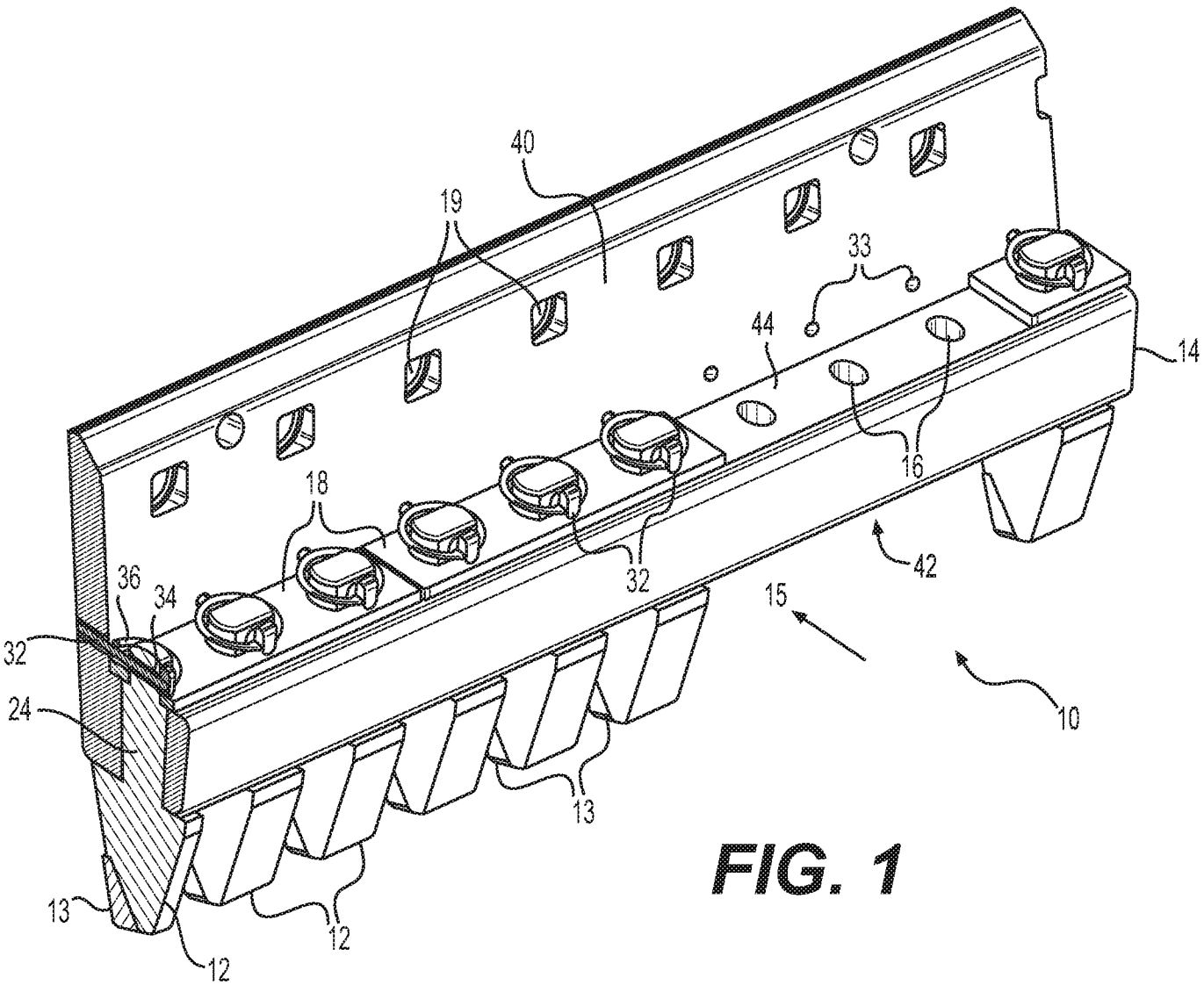
FIG. 1 is a perspective illustration of one embodiment of the bit securing system.

FIG. 1 illustrates one embodiment of the system 10 for securing bits 12 against rotation. In this embodiment, the system 10 includes at least two bits 12. Each bit 12 has a tooling surface 13, and is designed to operate facing a forward direction 15, as shown. An adapter board 14 secures the bits 12 such that the tooling surfaces 13 are facing the forward direction 15. The adapter board 14 includes at least two bit holes 16, and each bit 12 is removably received within a respective bit hole 16 in the adapter board 14. The bits 12 are inserted into the bit holes 16 from a lower surface 42 of the adapter board 14. An anti-rotation plate 18 is then positioned on an upper surface 44 of the adapter board 14 such that it engages with the bits 12 to constrain the bits 12 against rotation. The adapter board 14 also has an interference surface 40 extending from the upper surface 44, and the interference surface 40 has a plurality of mounting points 19 configured to mount the adapter board 14 to the motor grader.

Each anti-rotation plate 18 is constrained against rotation with respect to the adapter board 14 by engaging at least two bits 12. The anti-rotation plate 18 may be configured to engage any suitable number of bits 12, however. As shown in FIG. 1, each anti-rotation plate 18 may engage three bits 12. Alternatively, each anti-rotation plate 18 may engage five bits 12, for example.

Figure 2:
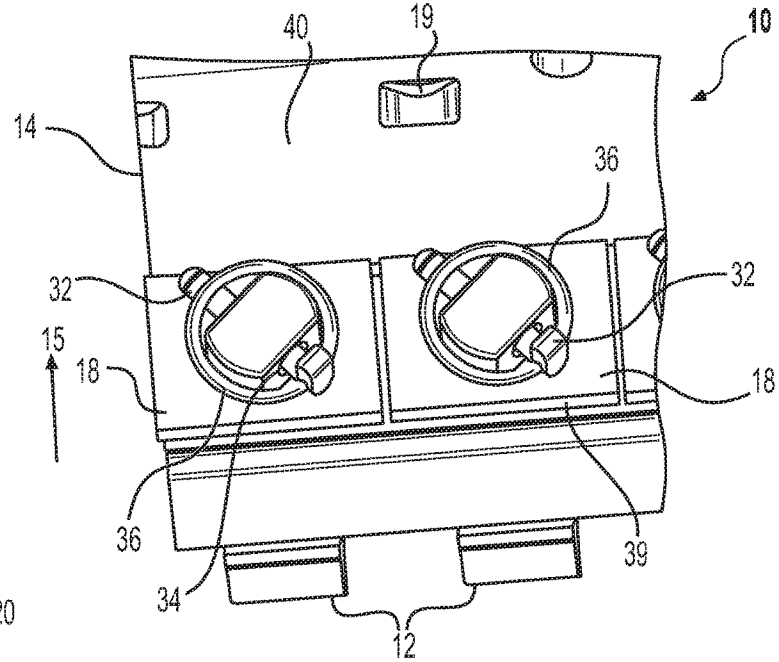
FIG. 2 is a perspective illustration of another embodiment of the bit securing system.

FIG. 2 illustrates a second embodiment of the bit securing system 10. Unlike the embodiment illustrated in FIG. 1, a separate anti-rotation plate 18 is provided for each bit 12. Each anti-rotation plate 18 engages with one respective bit 12 to constrain it against rotation. Each anti-rotation plate 18 also abuts one or more of the interference surface 40 of the adapter board 14 and the adjacent anti-rotation plate 18 such that the anti-rotation plate 18 is constrained against rotation with respect to the adapter board 14.

The bit holes 16 may be formed between the lower surface 42 and the upper surface 44 of the adapter board 14. The circular portion 26 of the shank 24 may be sized such that when the system 10 is assembled, the shoulder 20 of the bit 12 contacts the lower surface 42 of the adapter board 14. When assembled, a locking portion 28 of the shank 24 extends at least partially outside of the bit hole 16 of the adapter board 14 from the upper surface 44. The anti-rotation plate 18 is then positioned on the upper surface 44 of the adapter board 14 such that the slot 38 in the anti-rotation plate 18 receives the locking portion 28 of a respective shank 24. Additionally, in some embodiments, the locking portion 28 of the bit 12 may be sized such that the locking portion 28 is at least partially received within the bit hole 16 in the adapter board 14 when the system 10 is assembled. In other words, the locking portion 28 may be disposed at least partially within the bit hole 16 in the assembled state.

Figure 3:
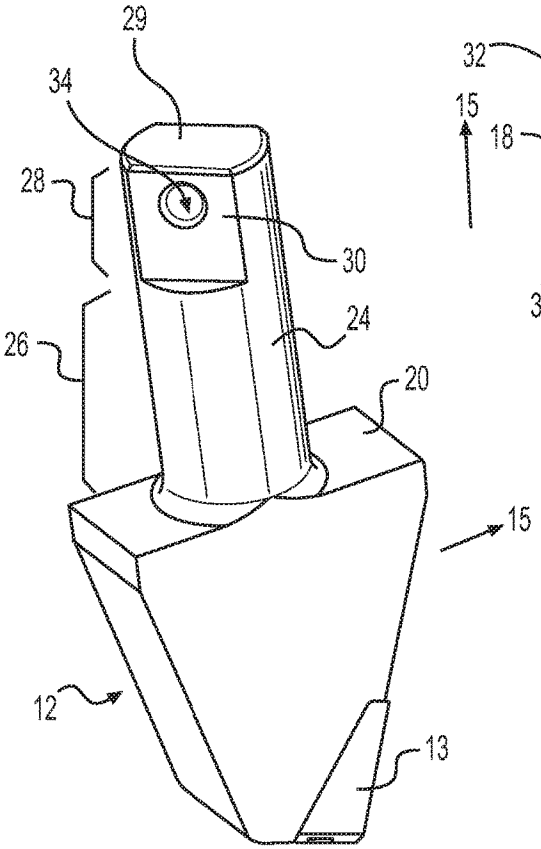
FIG. 3 is a perspective illustration of an exemplary bit of the embodiment illustrated in FIG. 2.

FIG. 3 illustrates an exemplary bit 12 according to the embodiment illustrated in FIG. 2. The bit 12 has a shoulder 20 and a shank 24 protruding from the shoulder 20. The shank 24 includes a circular portion 26, the locking portion 28, and an end 29. The locking portion 28 is disposed at the end 29 of the shank 24, and the circular portion 26 is disposed between the locking portion 28 and the shoulder 20. The circular portion 26 has a circular cross-sectional shape, and the locking portion 28 has a non-circular cross-sectional shape. In this embodiment, the locking portion 28 has a pair of flat, parallel engagement surfaces 30.

The locking portion 28, however, may have any suitable non-circular cross-sectional shape such that the anti-rotation plate 18 can engage the locking portion 28 when the system 10 is assembled and constrain the bit 12 against rotation. For example, in other embodiments, the engagement surface 30 may be curved. In other embodiments, the locking portion 28 may only have one engagement surface 30. Alternatively, the locking portion 28 may have more than two engagement surfaces 30. For example, multiple engagement surfaces 30 may define a cross-sectional shape of the locking portion 28 that is triangular, square, rectangular, or pentagonal, etc.

The engagement surface 30 may be formed using any suitable method known in the art. For example, the engagement surface 30 may be formed by removing material from the shank 24. When first formed, the shank 24 may have a circular cross section along its entire length. One or more engagement surfaces 30 may then be formed by removing a portion of the shank 24 using any suitable technique. For example, the shank 24 may be machined, ground, cut, etched etc. to form one or more engagement surfaces 30 in the locking portion 28. Any other suitable manufacturing technique may be used to form a locking portion 28 having a non-circular cross sectional area. For example, the bit 12 may be cast using a mold. Alternatively, various portions of the bit 12 may be formed separately and welded together.

FIG. 3 illustrates one possible configuration for the locking portion 28 of the shank 24. Two parallel engagement surfaces 30 are disposed at a 45 degree angle with respect to the forward direction 15. The engagement surfaces 30 may be oriented in any suitable direction, however. For example, in the embodiment illustrated in FIG. 1, the engagement surfaces 30 are disposed perpendicular to the forward direction 15.

The circular portion 26 is configured to be received within a respective bit hole 16 of the adapter board 14. For example, both the circular portion 26 of the shank 24 and the bit holes 16 of the adapter board 14 may be sized such that circular portion 26 can be easily inserted and removed from a respective bit hole 16. For example, the circular portion 26 of the shank 24 and the bit holes 16 of the adapter board 14 may form a sliding or running fit.

Figure 4:
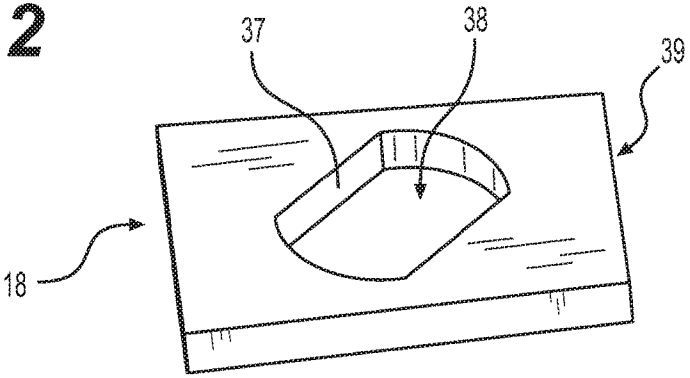
FIG. 4 is a perspective illustration of the anti-rotation plate of the embodiment illustrated in FIG. 2.

The anti-rotation plate 18 of the embodiment illustrated in FIGS. 2 and 3 is illustrated in FIG. 4. The anti-rotation plate 18 includes a slot 38 configured to engage the non-circular cross-sectional shape of the locking portion 28 of the shank 24. In this embodiment, the slot 38 is configured to interlock with the non-circular cross-sectional shape of a respective locking portion 28 of each shank 24. The slot 38 includes a shape that is complementary with respect to the non-circular cross-sectional shape of the locking portion 28 of the shank 24. The inner edge 37 of the anti-rotation plate 18, which forms the slot 38, has at least one surface configured to interfere with the engagement surface 30 of the locking portion 28 when the system 10 is assembled. In other words, the inner edge 37 of the anti-rotation plate 18 contacts the engagement surface 30 of the locking portion 28 of the shank 24 such that the bit 12 is constrained against rotation. To form the slot 38 in the anti-rotation plate 18, any suitable technique may be used. For example, the slot 38 may be machined, cut, punched, etc. Alternatively, the anti-rotation plate 18 may be cast in a mold, for example.

When the anti-rotation plate 18 is installed as shown in FIG. 2, an outer edge 39 of the anti-rotation plate 18 interferes with the outer edge 39 of an adjacent anti-rotation plate 18. The outer edge 39 may additionally interfere with an interference surface 40 of the adapter board 14. The outer edge 39 of the anti-rotation plate 18 may form any suitable shape. As shown in FIG. 2, the outer edge 39 may form a rectangular shape. This interference constrains the anti-rotation plates 18 against rotation with respect to the adapter board 14. Some slight amount of rotation may still be possible depending on the tolerances of the various components. For example, the anti-rotation plate 18 may be constrained against rotating more than three degrees with respect to the adapter board 14. Similarly, some slight relative rotation may be possible between the shank 24 of the bit 12 and the anti-rotation plate 18. The bit 12 may be constrained against rotating more than three degrees with respect to the anti-rotation plate 18.

The embodiment illustrated in FIG. 2 includes a linchpin 32 configured to prevent the bit 12 from backing out of the bit hole 16 in the adapter board 14. The shank 24 of the bit 12 includes a hole 34 configured to receive the linchpin 32. The hole 34 may be formed in the locking portion 28 of the shank 24, for example. In the assembled state as shown in FIG. 2, linchpins 32 are received within the holes 34 in the shanks 24. The linchpin 32 may include a rotatably connected ring 36, which may be rotated to the position shown in FIG. 2 to secure the linchpin 32 from backing out. Because the parallel engagement surfaces 30 are not perpendicular to the forward direction 15, this configuration facilitates easy insertion of each linchpin 32 into a respective hole 34 in one of the shanks 24 without contacting the interference surface 40. Similarly, this configuration also allows for removal of the linchpin 32 without interference from an adjacent linchpin 32 or bit 12. The hole 34 and linchpin 32 may be oriented in any suitable direction, however.

In the embodiment illustrated in FIG. 1, the engagement surfaces 30 are disposed perpendicular to the forward direction 15 when the system 10 is assembled. A respective hole 33 is formed in the interference surface 40 of the adapter board 14 for each linchpin 32. Each hole 33 is configured to receive at least a portion of a respective linchpin 32. Once the linchpins 32 are installed, the rings 36 of the linchpins 32 are rotated to the position shown in FIG. 1 to prevent the linchpins 32 from backing out of the holes 34 in the shanks 24. In an alternative embodiment, the system 10 may secure the bits 12 against rotation without using any anti-rotation plates 18 whatsoever. Rather, each linchpin 32 may secure a respective bit 12 against rotation by engaging a respective hole 33 in the interference surface 40 and a respective hole 34 in the bit 12.

The embodiment illustrated in FIG. 1 may alternatively be configured without holes 33 in the interference surface 40 to receive the linchpins 32. Rather, the linchpins 32 may be oriented such that they do not contact the interference surface 40 as in the embodiment illustrated in FIG. 2, for example. Any suitable orientation may be used, however. Alternatively, the linchpins 32 may be shorter in length, such that they do not contact the interference surface 40 when oriented as shown in FIG. 1. Alternatively, the bit holes 16 in the adapter board 14 may be disposed farther from the interference surface 40 of the adapter board 14 than as illustrated in FIG. 1.

Referring again to the embodiment illustrated in FIG. 1, contact with more than one bit 12 adequately constrains the anti-rotation plate 18 against rotation. The anti-rotation plate 18, however, may additionally be constrained against rotation in the same manner as described in the embodiment illustrated in FIG. 2. In other words, the anti-rotation plate 18 may also contact one or more of the interference surface 40 of the adapter board 14 and an adjacent anti-rotation plate 18 as described with reference to FIG. 2. This additional constraint, however, is not necessary for the embodiment shown in FIG. 1. Rather, in this embodiment, the anti-rotation plate 18 may be shaped such that it does not contact or interfere with an adjacent anti-rotation plate 18 or the interference surface 40 of the adapter board 14.

In another embodiment, the system 10 may be configured to only allow installation of the bits 12 in a forward-facing orientation. This configuration is not shown in the figures. For example, a portion of the outer edge 39 of the anti-rotation plate 18 that is opposite the interference surface 40 may include a protrusion, such as a tab. The protrusion and interference surface 40 may prevent the anti-rotation plates 18 from being installed such that the bit 12 faces backwards once installed. Alternatively, the outer edges 39 of the anti-rotation plates 18 may be configured to interlock with the outer edges 39 of adjacent anti-rotation plates 18 such that the anti-rotation plates 18 must be installed facing the same direction. The anti-rotation plate 18 and bit 12 may be similarly configured to prevent assembly with the bit facing any direction except forward. For example, the pair of engagement surfaces 30 of the locking portion 28 may be disposed in a non-parallel configuration. The slot 38 of the anti-rotation plate 18 may have a corresponding shape. Thus, the system 10 may be configured to prevent assembly with the bits 12 facing any direction except the forward direction 15.

The forward direction 15 refers to the movement of the motor grader when driven forward. In the embodiments illustrated in FIGS. 1 and 2, the anti-rotation plates 18 are configured to secure the bits 12 facing the forward direction 15. The adapter board 14 is secured to the motor grader such that the forward direction 15 of the motor grader is perpendicular to the interference surface 40 of the adapter board 14. In other words, a 90 degree angle is formed between the forward direction 15 and the interference surface 40. Alternatively, in another embodiment, the adapter board 14 may be secured at an angle such that the interference surface 40 is not perpendicular to the motor grader's movement in the forward direction 15. For example, the adapter board 14 may be angled to one side such that the interference surface 40 and the forward direction 15 form an 80 degree angle, instead of a 90 degree angle. The anti-rotation plates 18 may be configured to secure the bits 12 at an angle offsetting the angle between the adapter board 14 and the forward direction 15. Thus, the anti-rotation plates 18 may be configured to still secure the bits 12 facing the forward direction 15 of the motor grader. In one embodiment, the system 10 may include several sets of anti-rotation plates 18. A first set may be configured to secure the bits 12 at an 80 degree angle with respect to the interference surface 40, for example. A second set may be configured to secure the bits 12 at a 70 degree angle with respect to the interference surface 40, for example, and so forth. Thus, each set of anti-rotation plates 18 may secure the bits 12 at an angle corresponding to the angle of the adapter board 14 with respect to the forward direction 15. Thus, the adapter board 14 may be secured to the motor grader with the interference surface 40 at a variety of angles with respect to the forward direction 15, for example, between 70 degrees and 110 degrees. An appropriate set of anti-rotation plates 18 may then be selected corresponding to the orientation of the adapter board 14 such that all of the bits 12 are still secured facing the forward direction 15 of the motor grader's movement.

INDUSTRIAL APPLICABILITY

The disclosed bit securing system 10 finds potential application in any device requiring a bit 12 to be secured in a particular orientation. The disclosed bit securing system 10 finds particular applicability with motor graders having adapter boards 14 securing bits 12. Assembly of the bit securing system 10 will now be explained.

One embodiment of the system 10 is shown in FIG. 1. To assemble the system 10, each shank 24 of a respective bit 12 is inserted within a respective bit hole 16 of the adapter board 14. Once the shank 24 is fully inserted, the shoulder 20 of the bit 12 contacts the lower surface 42 of the adapter board 14. Then, the anti-rotation plate 18 is positioned on the upper surface 44 of the adapter board 14 such that the shanks 24 of at least two bits 12 are received within the slots 38 of the anti-rotation plate 18 and such that the anti-rotation plate 18 engages the locking portions 28 of the bits 12. Linchpins 32 are then installed in the holes 34 in the shanks 24 to prevent the bits 12 from backing out of the adapter board 14. The rings 36 of the linchpins 32 are rotated to the position shown in FIG. 1 to prevent the linchpins 32 from backing out of the holes 34 in the shanks 24.

The disclosed system 10 easily facilitates replacing worn bits 12. As they become worn, the bits 12 can be individually replaced, if necessary, by reversing the assembly process described above. Unlike snap rings, the linchpins 32 used in the disclosed embodiments can be easily removed by hand without specialized tools.

The disclosed system 10 also constrains the bits 12 against rotation after the lower surface 42 of the adapter board 14 has become severely worn. As the adapter board 14 and bits 12 are forced against the ground, terrain inconsistencies such as rocks or gravel, may scrape and grind against the lower surface 42 of the adapter board 14. As the lower surface 42 of the adapter board 14 is worn down by these abrasions, the anti-rotation plate 18 and the locking portion 28 of the bit 12 remain unaffected because they are disposed on the upper surface 44 of the adapter board 14. Additionally, as the adapter board 14 becomes severely worn, the abrasions may reduce the thickness of the adapter board 14 as measured between the lower surface 42 and the upper surface 44. Despite the reduced thickness of the adapter board 14, however, the anti-rotation plates 18 may constrain the bits 12 against rotation by engaging the locking portions 28 of the bits 12. As explained in the previous section, the locking portions 28 may be partially received within the bit holes 16 below the upper surface 44 of the adapter board 14. Thus, once the thickness of the adapter board 14 is reduced, a segment of the locking portions 28 which was previously received within the bit holes 16 may now extend above the upper surface 44 such that the anti-rotation plate 18 may still engage the locking portions 28 despite the reduced thickness of the adapter board 14. This may extend the useful life of the bits 12.

The disclosed system 10 may also provide increased versatility. As explained in the previous section, the adapter board 14 may be secured to the motor grader such that the interference surface 40 is not perpendicular to the forward direction 15 of the motor grader's movement. For example, the adapter board 14 may be secured at an angle such that dirt and rocks dislodged by the bits 12 are pushed to one side of the adapter board 14, similar to the operation of a snow plow. A set of appropriately configured anti-rotation plates 18 may be selected depending on the desired angle of the adapter board 14 such that the bits 12 are still secured facing the forward direction 15. Because the bit holes 16 in the adapter board 14 are circular, the anti-rotation plates 18 may be configured to secure the bits 12 at any suitable angle with respect to the adapter board 14.

Lastly, the disclosed system 10 may be manufactured using simple and inexpensive processes. For example, a simple drilling process may be used to form the circular bit holes 16 in the adapter board 14. The disclosed system 10 does not require any non-circular slot 38 in the adapter board 14 to secure the bits 12. The locking portions 28 of the bits 12 may also be easily formed by removing material from an initially cylindrical shank 24 using any suitable technique, such as machining, cutting, grinding etc. The anti-rotation plate 18 may also be easily formed using any suitable technique including forming a flat plate and then punching or cutting the slot 38. Alternatively, the anti-rotation plate 18 may be cast in a mold.

It will be apparent to those skilled in the art that various modifications and variations can be made to the disclosed system without departing from the scope of the disclosure. Other embodiments of the system will be apparent to those skilled in the art from consideration of the specification and practice of the disclosed bit securing system disclosed herein. It is intended that the specification and examples be considered as exemplary only, with a true scope being indicated by the following claims and their equivalents.

What is claimed is:

1. A bit securing system comprising:

at least two bits, each bit including a respective shank, each shank including a respective locking portion;

an adapter board including at least two holes, each respective hole of the adapter board configured to receive one respective shank of the at least two bits; and an anti-rotation plate configured to engage the respective locking portions of the shanks of the at least two bits such that the anti-rotation plate constrains the at least two bits against rotation with respect to the adapter board, wherein the adapter board includes a lower surface and an upper surface;

each bit includes a respective shoulder;

each shank extends from a respective shoulder; and when each shank of the at least two bits is received within a respective hole of the adapter board with each shoulder abutting the lower surface of the adapter board, the respective locking portions extend outside each respective hole from the upper surface of the adapter board.

2. The bit securing system of claim 1, wherein:

the locking portion of each shank includes a non-circular cross-sectional shape;

the anti-rotation plate includes at least two slots; and each slot is configured to engage the non-circular cross-sectional shape of a respective locking portion of each shank.

3. The bit securing system of claim 2, wherein each slot of the anti-rotation plate is configured to interlock with the non-circular cross-sectional shape of a respective locking portion of each shank.

4. The bit securing system of claim 2, wherein each slot of the anti-rotation plate includes a complementary shape with respect to the non-circular cross-sectional shape of a respective locking portion of each shank.

5. The bit securing system of claim 1, wherein:

each locking portion of the at least two bits includes an engagement surface;

the anti-rotation plate includes at least two slots;

each slot is configured to receive a respective locking portion; and the anti-rotation plate is configured to contact the engagement surface of each locking portion.

6. The bit securing system of claim 1, wherein:

each locking portion of the at least two bits includes an engagement surface;

the anti-rotation plate includes at least two slots; and when two or more locking portions of the at least two bits are received within respective slots of the anti-rotation plate, the anti-rotation plate abuts the engagement surfaces of the locking portions.

7. A bit securing system comprising:

at least two bits, each bit including a respective shank, each shank including a respective locking portion;

an adapter board including at least two holes, each respective hole of the adapter board configured to receive one respective shank of the at least two bits;

an anti-rotation plate configured to engage the respective locking portions of the shanks of the at least two bits such that the anti-rotation plate constrains the at least two bits against rotation with respect to the adapter board; and a plurality of linchpins, wherein each locking portion includes a respective hole configured to receive at least a portion of a respective linchpin therein.

* * * * *